United States Patent [19]

Atkinson

[11] 4,329,807

[45] May 18, 1982

[54] AERODYNAMIC TOY AND METHOD

[76] Inventor: Kevin Atkinson, 14515 Oakmont, Dallas, Tex. 75234

[21] Appl. No.: 131,404

[22] Filed: Mar. 17, 1980

[51] Int. Cl.[3] ..... A63H 27/14; A63H 27/00; A63B 71/00

[52] U.S. Cl. ..... 46/81; 46/74 R; 46/76 R; 273/129 P; 273/425; 273/428; 124/5; D21/86; D21/98

[58] Field of Search ..... 46/76 R, 74 R, 76 A, 46/83, 74 B, 74 D, 60, 67, 47, 69, 81; 124/4, 5, 7, 17, 16, 41 R, 10, 81, 21, 79, 8, 20 R; 273/424, 425, 129 R, 129 P, 317, 327, 343, 428; D21/85, 86, 82, 91, 92, 95, 98

[56] References Cited

U.S. PATENT DOCUMENTS

| | | | |
|---|---|---|---|
| 53722 | 4/1866 | Wyckoff | 408/204 |
| 72,174 | 12/1867 | Doisy | 46/220 |
| 1,116,786 | 11/1914 | Beadles | 273/129 P |
| 1,270,378 | 6/1918 | Cobarubia | 273/129 P |
| 1,779,187 | 10/1930 | Pearson | 273/129 R |
| 2,683,603 | 7/1954 | Gackenbach | 273/428 |
| 3,018,584 | 1/1962 | Passariello | 46/72 |
| 3,095,867 | 7/1963 | Kiyuna | 124/5 |
| 3,430,620 | 3/1969 | Davis | 124/41 R |
| 3,982,489 | 9/1976 | Flatean et al. | 46/74 R |
| 4,151,674 | 5/1979 | Klahn et al. | 46/74 R |

FOREIGN PATENT DOCUMENTS

| | | | |
|---|---|---|---|
| 467331 | 12/1951 | Italy | 46/74 D |

*Primary Examiner*—Gene Mancene
*Assistant Examiner*—Michael J. Foycik
*Attorney, Agent, or Firm*—Stanley R. Moore; Thomas L. Crisman

[57] ABSTRACT

An aerodynamic toy adapted for spinning and throwing having a cylindrical ring with at least one retaining element thereon and a tether for engaging at least one of the retaining elements, which tether can be also gripped by the thrower's hand to enable the thrower to impart a spin to the ring thereby moving the toy in a forward direction generally parallel to the axis of spin. The spin of the cylindrical toy imparts an inertial stability and the cylindrical shape causes the ring to glide through the air over great distances.

16 Claims, 14 Drawing Figures

AERODYNAMIC TOY AND METHOD

BACKGROUND OF THE INVENTION

The invention relates to aerodynamic toys, and, more particularly, to a cylindrical ring adapted to be spun and thrown thru the air in a direction orthogonal to the plane of the ring.

Over the past several years flying toys such as aerodynamic blades, balls and saucers have become quite popular as throwing implements. Most of these items are thrown in a direction parallel to the axis of their greater length; i.e. horizontally. The conventional i.e. embodiment of such an aerodynamic toy includes a plastic material in a saucer shape with a rim located around the outer edge, the rim having a somewhat greater thickness than the saucer portion of the toy. The rim curves downwardly from the saucer and has a configuration such that the implement when viewed in elevation approximates the shape of an air foil.

The above described toy is used in throwing games and is normally gripped by placing the thumb on the convex side of the saucer and one or more of the fingers on the concave side. Throwing is usually accomplished by holding the saucer generally parallel to the ground and spinning it with a wrist snapping motion. The thrower assumes a stance approximately at right angles to the intended target and moves his arm across his body. By uncoiling his arm and snapping his wrist, momentum and a spinning motion generally orthogonal thereto is imparted to the saucer to cause it to soar toward the target. The direction of flight from the thrower depends upon the thrower's skill and the type of flight path depends upon the angle of the saucer relative to the ground when it is released by the thrower. Its appeal as a toy appears to reside to the fact that it manifests definite flight characteristics often found fascinating by observers; can be made to do maneuvers of various kinds depending upon the air movement and skill of the user; and is relatively easy to master. The most popular of the saucer shaped toys is the flying saucer which is disclosed and claimed in U.S. Pat. No. 3,359,678 issued on Dec. 26, 1967 to Edward E. Headrick and assigned to Whamo Manufacturing Company.

In recent years the concept of the UFO (unidentified flying object) has found widespread popularity and emphasis and saucer shaped flying toys have realized world wide popularity. UFO depictions of literary and artistic genesis have included saucer shaped embodying various flight configurations. For example, the upstanding central hub-saucer form has found considerable public recognition. Aerodynamic toys have thus been developed which incorporate the hubbed saucer. The more flight efficient saucers are constructed primarily for conventional air flow considerations (such as leading edge disk continuities causing the spoiling of air rushing thereacross). Such aerodynamic designs do contribute greatly to the performance of saucer shaped toys because the direction of travel is generally orthogonal to the axis of spin.

Prior art aerodynamic toys have also included spheroid and elongate cylindrically shaped implements which when spun and propelled axially by the thrower facilitate stabilized forward momentum. One such example is the football which utilized inertial stability and aerodynamic design. Other aerodynamic designs have included the long, thick walled cylindrical tubes often having tapered leading edges for channeling air. The throwing of all such flying implements is basically analogous to the firing of a long, rifled projectile where the axial spin imparts stability to the forward motion of the projectile. While such elongate implements are enjoyable and produce fruitful exploitations of certain aerodynamic phenomenon, another, shorter adaptation of the cylindrical flying implement can provide very surprising aerodynamic performance as it flies in a generally vertical position as compared to conventional horizontal orientations.

The present invention is provided in such a construction facilitating inexpensive fabrication and a myriod of advantages over prior art flight toys.

SUMMARY OF THE INVENTION

The present invention relates to an improved aerodynamic toy. More particularly, one aspect of the invention relates to an improved aerodynamic toy comprising a cylindrical ring adapted for a generally vertical flight orientation and having relatively thin side walls adapted for spinning generally around a horizontal, axial flight path established principally by throwing momentum having at least one retaining element and tether means for engaging at least one of said retaining elements to permit the thrower to impart a high degree spin to the ring at the same time it is propelled forward, generally in the direction of the axis of the spin.

The invention also comprises the method of illustrating gyroscopic stability in flight utilizing said aerodynamic toy as more specifically described below.

In another embodiment, the invention includes a plurality of notches formed along one of two opposite edges of the ring. A looped filament is provided for engagement with one of the notches formed in the ring and the thrower's hand or fingers. In this manner the thrower may impart a high degree spin to the ring at the same time it is propelled forward, generally in the direction of the axis of the spin.

Another embodiment of the invention includes a weighted cylindrical ring constructed into the cylindrical side walls of the aerodynamic toy to impart increased inertial stability from the axial spin. The central weight ring may be constructed of metal and utilized to compensate for greater width designs of the present invention and/or the utilization of a plurality of materials.

In yet another embodiment of the present invention the leading edge of the cylindrical ring may include a taper and/or a plurality of wind spoiling projections for interrupting the smooth flow of air over this spinning surface. In aerodynamics this action is described as "spoiling" the air flow. As applied to the present invention, this disruption of air flow is thought to create a turbulent, unseparated cylindrical boundary layer over the vertically oriented spinning ring for imparting select flight patterns. The vertical flight orientation of the ring in conjunction with its relatively short length, or side wall length, provides unusual and advantageous flight patterns.

BRIEF DESCRIPTION OF THE DRAWINGS

For a more complete understanding of the present invention, and for further objects and advantages thereof, reference may be now had to the following description taken in conjunction with the accompanying drawings in which.

DETAILED DESCRIPTIONS

Figure 1:
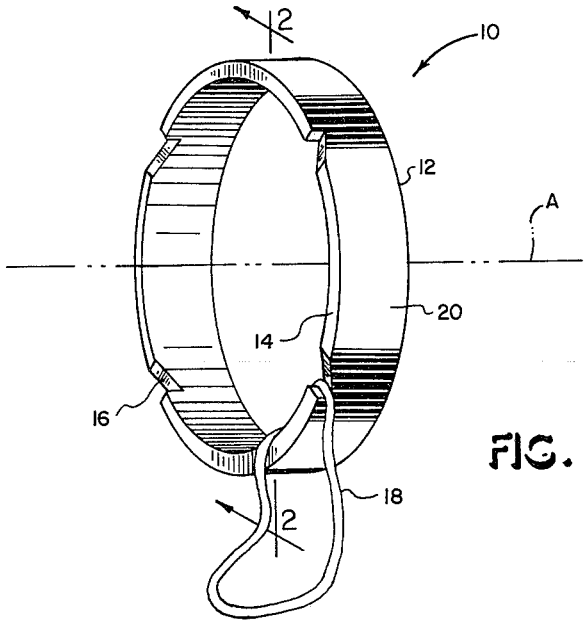
FIG. 1 is a perspective view of one embodiment of an aerodynamic toy constructed in accordance with the principles of the present invention.

Referring first to FIG. 1 there is shown one embodiment of an aerodynamic toy or flight ring constructed in accordance with the principles of the present invention. The aerodynamic toy 10 is comprised of a relatively short, cylindrical ring having opposed outer edges 12 and 14 in generally parallel spaced alignment. In the particular configuration of the toy 10 of the present invention a plurality of attachment means, or retaining elements, shown herein as notches 16 are formed in the edge 14 for permitting an axial spin to be imparted to the toy 10 during the throwing motion. Means for propelling the toy 10 with an axial spin which stabilizes a generally vertical flight position includes tether member 18 formed with a loop configuration. One embodiment of the tether 18 is an elastic member such as a rubber filament or the like, which engages one of the notches 16 and is stretched relative to the thrower's hand (not shown). The contraction of the tether 18 causes the ring 10 to spin upon release from the securing grip of the thrower's hand and impart an inertial stability to the ring. Inertial stability is dependent upon the rate of spin and mass of the flight 10.

Figure 2:
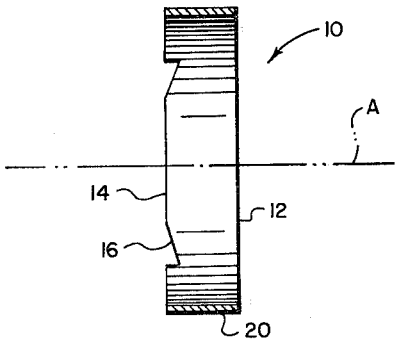
FIG. 2 is a side elevational, cross-sectional view of the aerodynamic toy of FIG. 1, taken along lines 2—2 thereof.

Referring now to FIG. 2, there is shown an enlarged side elevational, cross-sectional view of the flight ring 10 of the present invention illustrating the side wall construction thereof. It may be seen from this illustration that the embodiment of the particular aerodynamic toy shown herein incorporates a relatively thin wall construction which may be on the order of 1/16" thick. This and the following dimensions are given for purposes of reference only and are in no way meant to be limiting in scope of the present invention.

Still referring to FIG. 2 the particular embodiment of the aerodynamic ring 10 of the present invention shown herein is constructed with a 1/16" thick wall, 1 inch wide to comprise cylindrical wall 20. This relatively short, 1 inch cylindrical length has a diameter of approximately 4½ inch which has been shown to be satisfactory. The ring 10 of the foresaid dimensions constructed of polypropelene plastic or the like has an approximate weight of ½ oz. This weight has been shown to be satisfactory in light winds for flight distances on the order of 50 yards, a slightly heavier ring weight may be preferable. The above ring dimensions are representative of one embodiment only. Likewise, construction ratios are given for purposes of example only and include a ring diameter to length of the side wall: 4.5 to 1. Decreases in the diameter to a constant side wall length has a critical influence or stability through a range of (3.9 to 4.8) to 1.0 has been found acceptable. The ratio of side wall thickness to side wall length has likewise been found preferably in a range of 1 to 16. An acceptable range of (1.0 to 3.8) to 16 has been found acceptable without critically effecting flight performance. The larger wall thickness, more akin to certain prior art constructions, which lack the ability for prolonged flight in the vertically oriented position shown herein.

Figure 3:
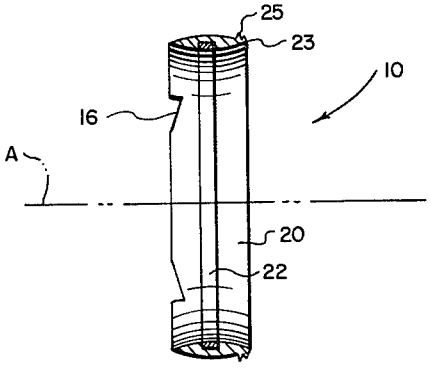
FIG. 3 is a side elevational, cross-sectional view of an alternative embodiment of the aerodynamic toy of FIG. 2.

Referring now to FIG. 3, there is shown an enlarged, cross-sectional view of an alternative embodiment of the present invention wherein the side wall 20 of the ring 10 is formed with a weighted portion 22. The inner ring 22 may be formed of metal such as aluminum or steel or the like. The utilization of a weighted ring, or equally spaced weighted sections in place thereof, imparts a higher mass to the side wall 20 which creates improved inertial properties when the toy 10 is spun about its central axis shown as dotted line A in FIGS. 1, 2 and 3. Such a weighted side wall is but one modification to the present invention which may enhance or provide versatility to the design and the performance thereof. Finally as shown in FIG. 3 the leading edges 23 may also be tapered with conventional airfoil designs including protuberances 25 for "spoiling" airflow to provide select aerodynamic characteristics. It should be noted, however, that the present invention specifically includes the thin walled construction shown and described herein which permits the vertical flight position as compared to conventional horizontal flight positions. The term vertical flight position refers to the vertical plane of the ring 10 defined by its outer, circular rim 12 or 14. This plane is basically orthogonal to the horizontal flight position of prior art saucers above discussed.

In yet another embodiment of the present invention not depicted the ring is not weighted and the leading edge of the cylindrical ring 20 may include a taper and/or a plurality of wind spoiling projections for interrupting the smooth flow of air over this spinning surface. In aerodynamics this action is described as "spoiling" the air flow. As applied to the present invention, this disruption of air flow is thought to create a trubulent, unseparated cylindrical boundary layer over the vertically oriented spinning ring for imparting select flight properties. The vertical flight orientation of the ring in conjunction with its relatively short length, or side wall length, provides unusual and advantageous flight patterns.

Figure 4:
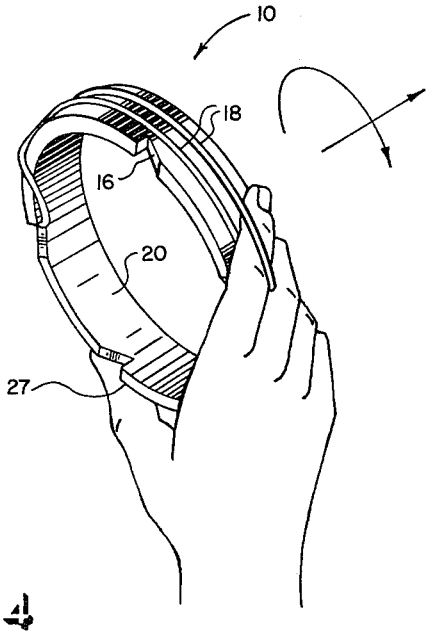
FIG. 4 is a perspective view of the aerodynamic toy of FIG. 1 shown in a position of pre-flight and gripped by a thrower's hand.

Referring now to FIG. 4 there is shown the ring 10 of the present invention held in the hand of a thrower. The tether 18 is secured within a notch 16 or the like, on the ring 10 and at its opposite end to the hand of the thrower as shown. Various manners of engaging the tether 18 may be incorporated in the present invention.

Preferably the thrower's hand grips the ring 10 along the "carriage" 27, defined as portions of the hand area between and extended thumb and forefinger. The tether 18 is then secured to one of the lower fingers of the hand. A tether 18 formed of elastic material, such as a rubber band, has been shown to be effective in imparting an axial spin to the ring 10 as it is released from the thrower's hand. The plurality of notches 16 facilitates quick engagement of the notch during a throwing game. It has also been shown that the tether 18 may be constructed of a non-elastic member such as plastic, or can be a string. In this manner the thrower must move his hand in a downward direction as the ring 10 is thrown in order to impart the spinning thereof.

Figure 5:
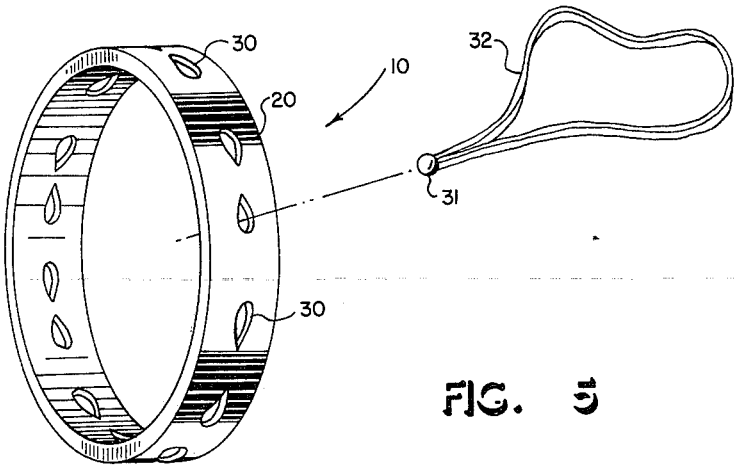
FIG. 5 is a perspective view of an alternative embodiment of the present invention.

A further embodiment of the invention is shown in FIG. 5 in which the edge of side wall 20 is provided with a plurality of tear-drop shaped openings 30 comprising another form of retaining elements. Openings 30 act to engage the ball end 31 of tether means 32. The thrower can then cast this embodiment of the toy in the same manner as the toy described with reference to FIG. 4.

Figure 6:
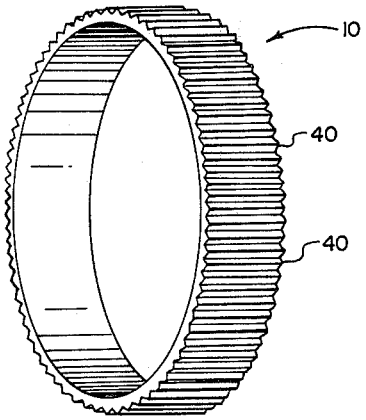
FIG. 6 is a perspective view of an alternative embodiment of the present invention.
Figure 6A:
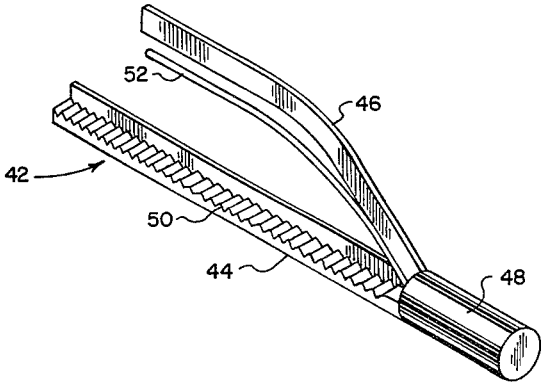
FIG. 6*a* is a perspective view of tether means for casting the embodiment of the present invention depicted in FIG. 6, FIGS. 7 and 8 are side elevational, cross-sectional views of alternative embodiments of the present invention.

FIG. 6 relates to another embodiment of the invention in which the side wall 20 is formed with a plurality of ridges 40. FIG. 6*a* depicts tether means 42 in the form of a sling for engaging the ridges 40 to cast the toy. Specifically tether or sling 42 has outer arms 44 and 46 rigidly mounted to and extending outwardly from handle 48. Lower arm 44 has ridges 50 which can mate with ridges 40 on side wall 20 and upper arm 46 acts as a guide and restraining member for flexible rod 52 spaced intermediate arms 44 and 46. The method of casting the ridged ring with tether 42 is largely evident from the description given of tether 42. The ridged ring 10 is forced between arms 44 and rod 52 and flexible rod 52 applies pressure to the top of ring 10 to force the respective ridges in arm 52 and ring 10 to engage the stay engaged until ring 10 released for flight. To release ring 10 the thrower simply grasps handle 48 of tether 42 and with a rapid wrist action snaps ring 10 from tether 42 so as to impart a rapid axial spin to the toy.

Figure 7:
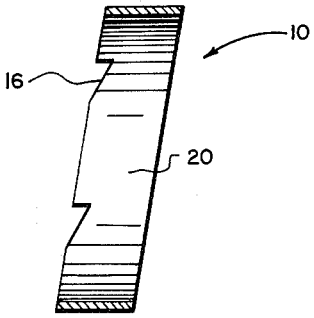
Figure 8:
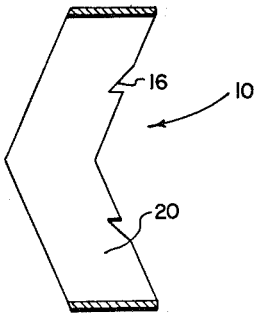

FIGS. 7 and 8, are alternate embodiments of the instant invention wherein side wall 20 of ring 10 is generally trapezoidal in shape in sectional side view. Such shapes are operative, but flight is not as suitable as rings having the cylindrical shape shown in FIG. 2 or 3. Various advantages may result from the incorporation of such trapezoidal configurations. In addition, it may be seen that a variety of notch shapes and spacings may be utilized within the spirit and scope of the invention.

Figure 10A:
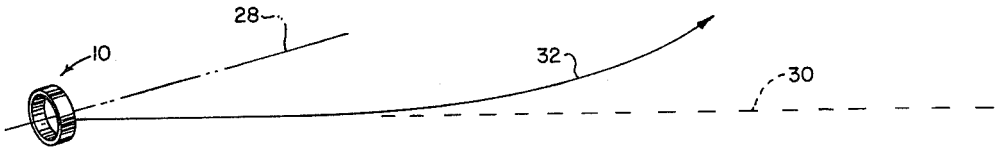
FIGS. 10*a*, 10*b*, and 10*c* are diagrammatical illustrations of three flight patterns of the methods and apparatus of the present invention.
Figure 10B:
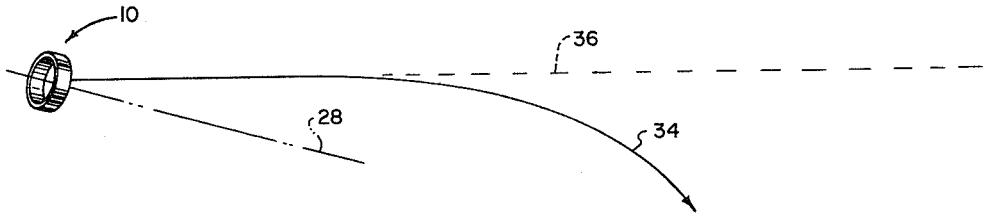
Figure 10C:
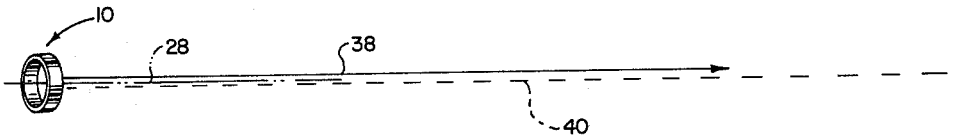

Referring now to FIGS. 10*a*, *b* and *c*, there is shown the flight pattern of three rings 10 constructed in accordance with the principles of the present invention. These flight patterns are shown for purposes of illustration in highlighting the flight characteristics and the aerodynamic properties of the present invention. FIG. 8*a* shows a ring 10 in an angulated position wherein the axis 28 of the ring 10 is inclined in an upward direction with the direction of throw from the thrower's arm along the line 30. The direction 30 is also the direction of the momentum of the ring 10 of the present invention as it is released; however, the upward inclination of the axis 28 causes the ring 10 to assume a flight path 32 as shown. (The flight path 32 is a departure from conventional aerodynamic toys in that momentum determines the initial flight path). The forwardly propelled ring 10 receives aerodynamic lift from its engagement with the air causing it to rise due to its angle of attack and imparting the upward lift to the flight path 32 shown herein. FIG. 10*b* illustrates a flight path 34 imparted to a ring 10 thrown with its axis 28 oriented toward the ground. The path 36 of initial momentum determines the initial direction of flight of the ring 10. The flight path 34 then is directed toward the ground as the angle of attack of the ring 10, stabilized by the axial spin, causes the ring to be directed downwardly. FIG. 10*c* illustrates a flight path 38 along a generally horizontal direction when the ring 10 has been thrown in a direction parallel to its axis of spin. In FIG. 10*c* the momentum direction of 40 is in generally parallel relationship with the axis 28.

The degree of flight stability and the aforesaid flight patterns may be affected to some degree by the thrower's precision in imparting spin to the ring 10 as it is thrown. The elastic tether 18 has been shown to be helpful in imparting spin without effecting lateral stability. It has been found that ring 10 is preferably constructed with a side wall width to diameter ratio on the order to 1 to 4. A ratio of side wall thickness to its overall length on the order of 16 to 1 has also been found desirable. Variations in the ratio of the length of the wall 20 to its thickness have been shown to have appreciable effects on the performance characteristics. In like manner the spacing of the notches 16 about the trailing edge 14 of the present invention is preferably axially symetrical whereby the spinning stability is not effected. A pattern of 4 notches spaced 90° apart relative to the axis of the ring 10 has been shown to be desirable. A tapered notch 16 having an inclined real wall 17 as shown in the drawings, facilitates effective release of the tether 18 from the spinning ring 10. An alternative embodiment of the tether 18 may include a single element interconnecting a pair of opposed loop portions, as shown in FIG. 11.

Figure 11:
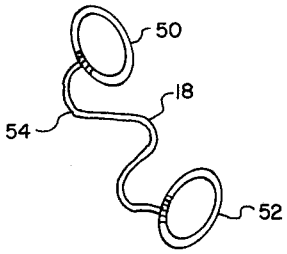
FIG. 11 is a perspective view of an alternative embodiment of the tether of FIG. 1 used to impart axial spin.

Referring now specifically to the embodiment of the tether 18 shown in FIG. 11, a first upper loop 50 may be provided with a second lower loop 52 interconnected with an elastic member 54. In this particular configuration, the lower loop 52 may be designed to receive one of the fingers of the thrower and may be comprised of a metal ring, either rigid and polished or adjustable in size. The loop 50 adapted to be received within the notches 16 of the ring 10 is preferable of a fixed size and may comprise member 54 in an "elastic" configuration. The member 54 and/or the loop 50, may be either elastic or of a select non-elastic length according to the desires of the user. As said before, the elastically properties of the tether 18 may afford advantageous flight characteristics in the fashion of high spin velocities. The overall length of the tether 54 may vary, though a relatively short length of around 2" has been shown to be preferable when utilizing an elastic member.

As to materials, while the ring has been described as preferably being constructed of a plastic material, such as polypropylene, it will be evident that the rings can be fabricated from wood or metal. It will also be evident that the shape of the notches 16 in side wall 20 can be varied in shape, such as being U-shaped or V-shaped, so long as the tether can be retained therein until released by the action of the thrower and that the notches can be formed in both sides of the ring. Also, in place of notches, tabs or knobs extending from the side of the ring can be used to engage the tether.

Figure 9:
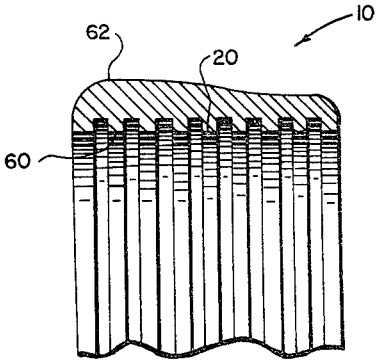
FIG. 9 is an enlarged, fragmentary side-elevational, cross-sectional view of an alternative embodiment of the present invention.

Referring now to FIG. 9, there is shown an enlarged, cross-sectional view of an alternative embodiment of the present invention. Only one side wall 20 is shown for purposes of clarity and includes a plurality of ribs 60 formed on the inside of wall 20. The ribs 60 may serve to catch the air during flight when the ring 10 is angulated in the fashion shown in FIG. 10*a* discussed above. This function has been shown to cause the ring 10 to advantageously hang in the air in the generally vertical position. Such an effect is desirable from a performance standpoint. An outer edge 62 of conventional airfoil design is also shown for purposes of illustration. Such air flow modifications can enhance specific performance characteristics of the ring 10 in accord with desired flight patterns.

It is thus believed that the operation and construction of the present invention will be apparent from the foregoing description. While the method and apparatus shown and described has been characterized as being preferred it will be obvious that various changes and modifications may be made therein without departing from the spirit and scope of the invention as defined in the following claims.

What is claimed is:

1. An aerodynamic toy having a leading and trailing edge and adapted to be spun by a tether and thrown into the air for flight by a person's throwing motion, said toy comprising a cylindrical ring having a relatively thin wall between said leading and trailing edges and means for retaining said tether upon said ring for throwing including irregularities formed along at least one edge of said ring to permit the thrower to impart an axial spin to said ring as it is released from the tether by the thrower's hand with a forward motion in a direction orthogonal to the plane of the ring and wherein gyroscopic stability is afforded to said ring facilitating its spinning flight through the air.

2. The apparatus as set forth in claim 1 wherein said retaining element includes at least one notch formed along one edge of said ring.

3. The apparatus as set forth in claim 1 wherein said ring is formed of light weight material having a wall length to wall thickness diameter of the order of 16 to 1.

4. The apparatus as set forth in claim 1 wherein the cylindrical ring includes 4 notches spaced 90° one from the other.

5. The cylindrical ring set forth in claim 1 wherein said tether means includes an elastomeric element.

6. The apparatus as set forlth in claim 1 wherein the diameter of the ring is on the order of 4½ times the length of the wall of said ring.

7. The apparatus as set forth in claim 1 wherein the leading edge of said ring is tapered for aerodynamic flow.

8. The apparatus as set forth in claim 1 wherein said ring includes an inner portion of heavier weight constructed within said ring.

9. The apparatus as set forth in claim 1 wherein said retaining element includes a plurality of ridges formed upon the wall of said ring and said tether means includes a sling having at least one arm formed with ridges therein for engaging the ridges of said ring.

10. The apparatus as set forth in claim 9 wherein said sling includes a second flexible rod constructed adjacent said ridged arm for facilitating engagement of the ridges of said sling and said ring.

11. A method of illustrating gyroscopic stability in the flight of an aerodynamic toy propelled by a tether land a person's throwing motion, said method comprising the steps of providing a cylindrical ring having a leading and trailing edge and relatively within wall therebetween and means for engageing one portion of said tether including irregularities formed along one edge of said ring and means for engaging a second portion of said tether with the hand of a thrower, moving the hand forward in a select trajectory and orienting the plane of said ring in a direction substantially orthogonal to said trajectory releasing said tether from said edge of the cylindrical ring in such a manner as to impart a spinning flight to the orientated cylindrical ring as it is released from the tether and whereby ryroscopic stability is imparted to the spinning ring in its orthogonal flight through the air.

12. The method as set forth in claim 11 wherein said retaining element comprises a plurality of notches formed along at least one edge of said ring.

13. The apparatus as set forth in claim 11 wherein said retaining element includes a plurality of apertures formed in the side wall of said ring.

14. The apparatus as set forth in claim 11 wherein said tether means comprises an elongate filament, one end of which includes means for engaging said retaining element.

15. The apparatus as set forth in claim 11 wherein said ring includes an inside wall having a plurality of ribs formed therein for catching air flowing thereagainst.

16. The apparatus as set forth in claim 11 wherein said tether means comprises an elastic filament, one end of which includes means for engaging said retaining element.

* * * * *